US012037671B2

(12) United States Patent
Trybus et al.

(10) Patent No.: US 12,037,671 B2
(45) Date of Patent: Jul. 16, 2024

(54) COPPER ALLOYS WITH HIGH STRENGTH AND HIGH CONDUCTIVITY, AND PROCESSES FOR MAKING SUCH COPPER ALLOYS

(71) Applicant: MATERION CORPORATION, Mayfield Heights, OH (US)

(72) Inventors: Carole L. Trybus, Mayfield Heights, OH (US); John C. Kuli, Jr., Mayfield Heights, OH (US); Christopher J. Taylor, Mayfield Heights, OH (US)

(73) Assignee: Materion Corporation, Mayfield Heights, OH (US)

( * ) Notice: Subject to any disclaimer, the term of this patent is extended or adjusted under 35 U.S.C. 154(b) by 79 days.

(21) Appl. No.: 17/603,187

(22) PCT Filed: Apr. 9, 2020

(86) PCT No.: PCT/US2020/027404
§ 371 (c)(1),
(2) Date: Oct. 12, 2021

(87) PCT Pub. No.: WO2020/210444
PCT Pub. Date: Oct. 15, 2020

(65) Prior Publication Data

US 2022/0205074 A1 Jun. 30, 2022

Related U.S. Application Data

(60) Provisional application No. 62/833,012, filed on Apr. 12, 2019.

(51) Int. Cl.

| | |
|---|---|
| ***C22F 1/08*** | (2006.01) |
| ***C21D 8/02*** | (2006.01) |
| ***C22C 9/00*** | (2006.01) |

(52) U.S. Cl.
CPC ..... *C22F 1/08* (2013.01); *C21D 8/0236* (2013.01); *C21D 8/0273* (2013.01); *C22C 9/00* (2013.01)

(58) Field of Classification Search
CPC ..... C22C 1/0425; C22F 1/08; C21D 8/0236; C21D 8/0273
See application file for complete search history.

(56) References Cited

U.S. PATENT DOCUMENTS 4,224,066 A 9/1980 Watson et al.
4,599,120 A 7/1986 Church et al.
(Continued)

FOREIGN PATENT DOCUMENTS

JP 2012012630 A 1/2012
JP 2015048523 A * 3/2015
(Continued)

OTHER PUBLICATIONS

Materion; "Formability of Materion Performance Alloys Strip Products"; Tech Brief, retrieved from internet on Feb. 28, 2024; https://materion.com/-/media/files/alloy/tech-briefs/tech-briefs---formability-of-materion-performance-alloys-strip-products.pdf (Year: 2024).*
(Continued)

*Primary Examiner* — Alexandra M Moore
*Assistant Examiner* — Austin Pollock
(74) *Attorney, Agent, or Firm* — COZEN O'CONNOR

(57) ABSTRACT

A copper alloy that is devoid of beryllium and has a 0.2% offset yield strength of at least 70 ksi and an electrical conductivity of at least 75% IACS is disclosed. The copper alloy comprises chromium, silicon, silver, titanium, zirconium, and balance copper. The alloy is prepared by cold working, solution annealing, and aging. The alloy can be used in several different applications.

9 Claims, 2 Drawing Sheets

(56) References Cited

U.S. PATENT DOCUMENTS

| | | | | |
|---|---|---|---|---|
| 6,749,699 | B2 | 6/2004 | Bogel et al. | |
| 7,182,823 | B2 | 2/2007 | Mandigo et al. | |
| 2017/0283910 | A1* | 10/2017 | Tsuru | C25D 5/505 |
| 2018/0241165 | A1* | 8/2018 | Matsuo | C22C 9/02 |
| 2018/0274074 | A1 | 9/2018 | Ito et al. | |

FOREIGN PATENT DOCUMENTS

| | | | | | |
|---|---|---|---|---|---|
| JP | 2015063741 | A | * | 4/2015 | C22C 9/00 |
| JP | 2016156057 | A | * | 9/2016 | |
| JP | 2017179502 | A | * | 10/2017 | |
| JP | 2018-159104 | A | | 10/2018 | |

OTHER PUBLICATIONS

International Application No. PCT/US2020/027404, International Search Report mailed Aug. 17, 2020, 1 page.

* cited by examiner

COPPER ALLOYS WITH HIGH STRENGTH AND HIGH CONDUCTIVITY, AND PROCESSES FOR MAKING SUCH COPPER ALLOYS

CROSS REFERENCE TO RELATED APPLICATIONS

This application is a national stage application of PCT/US2020/027404 filed on Apr. 9, 2020, which claims priority to U.S. Provisional Patent Application Ser. No. 62/833,012, filed Apr. 12, 2019, which is fully incorporated by reference herein.

BACKGROUND

The present disclosure relates to copper alloys with a combination of high 0.2% offset yield strength and high electrical conductivity. Also disclosed are methods of manufacturing such copper alloys, electrical and other components employing copper alloys, and components and articles made from such copper alloys.

Heat treatable copper alloys can be produced using existing processes to provide high electrical conductivity. However, these heat treatable copper alloys often are not chosen for use in commercial electronic devices, components, and parts. This is because, in part, even after full age hardening they do not exhibit a sufficiently high strength-to-weight ratio to supplant other choices such as aluminum or copper alloys, especially in high electrical current applications.

It would be desirable to provide high electrical conductivity copper alloys with improved thermo-mechanical properties, as well as processes to maximize the strength-to-weight ratio, formability, current carrying capacity, and/or thermal conductivity.

BRIEF DESCRIPTION

The present disclosure relates to copper alloys which have a 0.2% offset yield strength of at least 70 ksi and an electrical conductivity of at least 75% IACS. Also disclosed herein are processes which can be applied to the copper alloys to increase their 0.2% offset yield strength and/or their ultimate tensile strength.

Disclosed in various embodiments are copper alloys that comprise: from about 0.5 wt % to about 1 wt % chromium; from about 0.02 wt % to about 0.1 wt % silicon; from about 0.1 wt % to about 0.2 wt % silver; from about 0.015 wt % to about 0.05 wt % titanium; from about 0.02 wt % to about 0.06 wt % zirconium; and balance copper. The copper alloys have a 0.2% offset yield strength of at least 75 ksi and an electrical conductivity of at least 75% IACS.

The copper alloys may have an ultimate tensile strength of at least 80 ksi. The copper alloys may have a % total elongation to break of at least 7%. The copper alloys may have a formability ratio of 0.0/0.0, or of better than 1.0/1.0. Combinations of any two or more of these properties are also contemplated.

In some embodiments, the copper alloy has a 0.2% offset yield strength of at least 75 ksi and an electrical conductivity of at least 80% IACS. In other embodiments, the copper alloy has a 0.2% offset yield strength of at least 75 ksi; an electrical conductivity of at least 75% IACS; an ultimate tensile strength of at least 80 ksi; and a % total elongation to break of at least 8%.

In particular embodiments, the copper alloy may not contain tin or beryllium.

Also disclosed herein are articles formed from the copper alloys disclosed above and further herein.

Also disclosed are processes for making the Cu—Cr—Si—Ag—Ti—Zr alloys with the 0.2% offset yield strength and electrical conductivity described above. The initial copper alloy is cold worked to a first percentage of cold working (% CW). The cold-worked copper alloy is then solution annealed a first time for a first time period. The annealed copper alloy is cold worked a second time to a second % CW. The cold-worked copper alloy is solution annealed for a second time for a second time period. The solution annealed copper alloy is then cold worked a third time to a third % CW. The cold-worked copper alloy is then aged for a third time period to obtain the copper alloy with improved strength and electrical conductivity.

The first % CW may be from about 80% to about 95%. The second % CW may be from about 30% to about 80%. The third % CW may be from about 40% to about 80%. The minimum cumulative cold working from all three cold working steps should be at least 85%.

The first solution annealing may be performed at a temperature of about 950° C. to about 1050° C. The first time period may be from about 1 minute to about 10 minutes, including from about 2.5 minutes to about 5 minutes.

The second solution annealing may be performed at a temperature of about 950° C. to about 1050° C. The second time period may be from about 1 minute to about 10 minutes, including from about 1.3 minutes to about 4 minutes.

The aging may be performed at a temperature of about 400° C. to about 500° C. The third time period may be from about four hours to about 14 hours. The aging may be performed in a full hydrogen atmosphere.

These and other non-limiting characteristics of the disclosure are more particularly discussed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
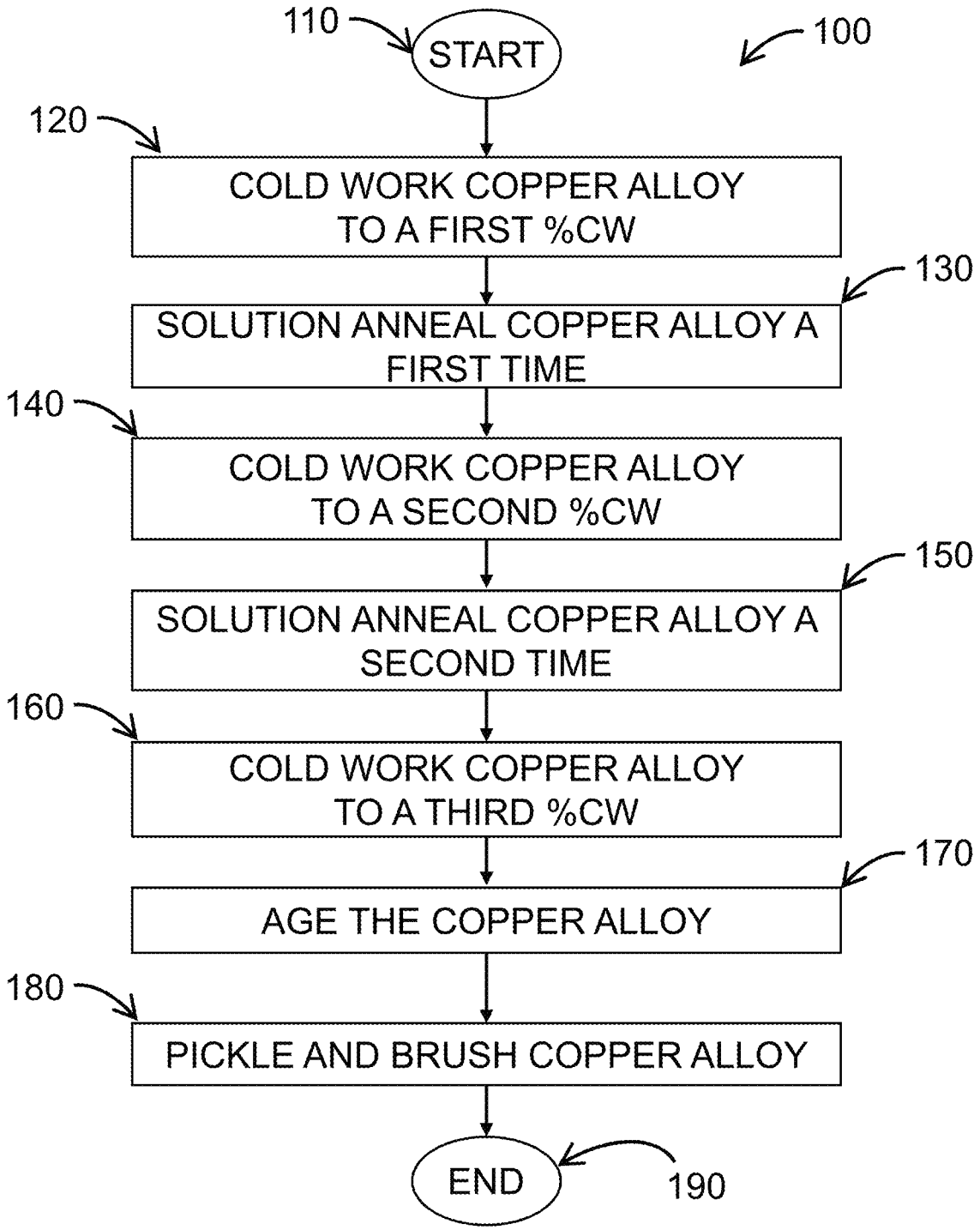
FIG. 1 is a flow-chart illustrating a process for preparing a high yield strength high-conductivity Cu—Cr—Si—Ag—Ti—Zr alloy, in accordance with one embodiment of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially", may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4". The term "about" may refer to ±10% of the indicated number.

The present disclosure may refer to temperatures for certain process steps. It is noted that these generally refer to the temperature at which the heat source (e.g. furnace) is set, and do not necessarily refer to the temperature which must be attained by the material being exposed to the heat.

Disclosed herein are copper alloys that comprise copper further alloyed with chromium, silicon, silver, titanium, and zirconium. The copper alloys do not include beryllium or tin. The disclosed alloys are amenable to strengthening without substantial loss of electrical conductivity using tempering operations such as annealing, cold working (e.g. cold rolling with or without tension, age hardening, and various combinations thereof). With suitable tempering, the disclosed copper alloys exhibit both high 0.2% offset yield strength and high electrical conductivity.

In accordance with another aspect of the present disclosure, methods of producing such copper alloys are disclosed which take advantage of multiple strengthening mechanisms. More specifically, the methods disclosed involve extensively cold working the copper alloys and solution annealing them to build cold worked dislocations in a single phase. The alloy is then aged to build small to medium size precipitates at a very high density. These processes can be applied to copper alloys which can be precipitation strengthened.

The copper alloys of the present disclosure contain chromium, silicon, silver, titanium, zirconium, and balance copper. The chromium is present in the copper alloys in an amount of from about 0.5 wt % to about 1 wt %, including from about 0.55 wt % to about 0.85 wt % or from about 0.65 wt % to about 0.80 wt %. The silicon is present in the copper alloys in an amount of from about 0.02 wt % to about 0.1 wt %, including from about 0.03 wt % to about 0.08 wt % of from about 0.04 wt % to about 0.065 wt %. The silver is present in the copper alloys in an amount of from about 0.1 wt % to about 0.2 wt %, including from about 0.11 wt % to about 0.15 wt % or from about 0.11 wt % to about 0.14 wt %. The titanium is present in the copper alloys in an amount of from about 0.015 wt % to about 0.05 wt %, including from about 0.02 wt % to about 0.04 wt %. The zirconium is present in the copper alloys in an amount of up to 0.05 wt %, including from about 0.02 wt % to about 0.06 wt %, or including from about 0.02 wt % to about 0.04 wt %. The balance of the copper alloy is copper, excluding impurities. Put another way, the copper may be present in an amount of about 98.59 wt % to about 99.345 wt %, or at least 98.8 wt %. Any combination of these amounts of each element is contemplated.

In specific embodiments, the copper alloy may comprise: about 0.55 wt % to about 0.85 wt % chromium; about 0.03 wt % to about 0.08 wt % silicon; about 0.11 wt % to about 0.15 wt % silver; about 0.015 wt % to about 0.05 wt % titanium; about 0.02 wt % to about 0.04 wt % zirconium; and balance copper.

In specific embodiments, the copper alloy may comprise: about 0.66 wt % chromium; about 0.04 wt % silicon; about 0.11 wt % silver; about 0.02 wt % titanium; about 0.03 wt % zirconium; and balance copper.

In other specific embodiments, the copper alloy may comprise: about 0.65 wt % to about 0.80 wt % chromium; about 0.04 wt % to about 0.065 wt % silicon; about 0.11 wt % to about 0.14 wt % silver; about 0.02 wt % to about 0.04 wt % titanium; about 0.02 wt % to about 0.04 wt % zirconium; and balance copper.

The copper alloys may also have some impurities, but desirably do not. Examples of such impurities may include tin, beryllium, titanium, magnesium, boron, oxygen, nickel, iron, cobalt, and sulfur. Some of these elements are sometimes added during processing for specific purposes. For example, boron and iron can be used to further enhance the formation of equiaxed crystals during solution heat treatment. In the manufacturing processes of the present disclosure, these elements are ideally not used. For purposes of this disclosure, amounts of less than 0.01 wt % of any of these elements should be considered to be unavoidable impurities, i.e. their presence is not intended or desired, and the total amount of such unavoidable impurities is usually less than 0.05 wt %. Some embodiments may additionally include iron and cobalt, but desirably do not. Some embodiments can contain up to 0.05 wt % iron and/or cobalt. However, preferred embodiments meet the performance and property characteristics, as disclosed herein, in the absence of these two elements.

It is noted the zirconium is intentionally added to act as a deoxidizer, and should not be considered an impurity. Zirconium silicides can affect the yield strength, are desirably not present in the copper alloys of the present disclosure. The copper alloys of the present disclosure should be substantially devoid of such zirconium silicides. Preferably, the zirconium is present in the form of zirconium oxides. Desirably, such oxides are in the form of small particles, and are not present as a continuous stringer.

After processing, the Cu—Cr—Si—Ag—Ti—Zr alloys will have certain properties. The final copper alloy may have a 0.2% offset yield strength of at least 70 ksi, or at least 72 ksi, or at least 75 ksi, and/or up to 90 ksi. The final copper alloy may have an ultimate tensile strength of at least 70 ksi, or at least 75 ksi, or at least 80 ksi, and/or up to 90 ksi. The final copper alloy may have an elastic modulus of at least 20 million psi (Msi), or at least 21 Msi, and/or up to 25 Msi. The final copper alloy may have a formability ratio of at least 1.0/1.0, and may have a ratio of 0.0/0.0 R/t. The final copper alloy may have a % total elongation to break of at least 7%, or at least 7.5%, or at least 8%, or at least 9%, and/or up to 12%. The final copper alloy may have an electrical conductivity of at least 50% IACS, or at least 60% IACS, or at least 70% IACS, or at least 71% IACS, or at least 72% IACS, or at least 73% IACS, or at least 74% IACS, or at least 75% IACS, or at least 76% IACS, or at least 77% IACS, or at least 78% IACS, or at least 79% IACS, or at least 80% IACS, and/or up to 85% or up to 90% IACS.

Any combination of the 0.2% offset yield strength, the ultimate tensile strength, the formability ratio, the % total elongation to break, and the electrical conductivity discussed above is contemplated for the Cu—Cr—Si—Ag—Ti—Zr alloys of the present disclosure.

In specific embodiments, the Cu—Cr—Si—Ag—Ti—Zr alloys of the present disclosure have a 0.2% offset yield strength of at least 70 ksi and an electrical conductivity of at least 75% IACS.

In specific embodiments, the Cu—Cr—Si—Ag—Ti—Zr alloys of the present disclosure have a 0.2% offset yield strength of at least 75 ksi and an electrical conductivity of at least 80% IACS.

In specific embodiments, the Cu—Cr—Si—Ag—Ti—Zr alloys of the present disclosure have a 0.2% offset yield strength of at least 70 ksi; an electrical conductivity of at least 75% IACS; an ultimate tensile strength of at least 75 ksi; and a % total elongation to break of at least 7%.

The zirconium in the Cu—Cr—Si—Ag—Ti—Zr alloy is used as a deoxidizer because it does not melt at low temperatures, does not generally detrimentally affect the electrical conductivity in the final alloy, does not tend to stay in solution with the copper, and usually improves the yield strength. In comparison, magnesium fades quickly, can cause the melt to "spit", and melts at a low temperature, which can cause difficulty during hot rolling. Manganese does not fade fast enough, and can detrimentally affect the electrical conductivity. Cadmium can cause issues during hot rolling and is also toxic. Lithium is relatively expensive.

Continuing now with reference to FIG. 1, a process 100 for making the Cu—Cr—Si—Ag—Ti—Zr alloys is illustrated in accordance with one embodiment of the present disclosure. The process 100 begins at step 110, wherein a copper alloy is provided. This Cu—Cr—Si—Ag—Ti—Zr alloy, also referred to as the initial copper alloy, has initial properties such as, for example, an initial 0.2% offset yield strength, an initial ultimate tensile strength, an initial formability ratio, an initial % total elongation to break, and/or an initial electrical conductivity (i.e. % IACS), prior to any processing according to the present disclosure.

The initial copper alloy can be provided in the form of a casting. Alternatively, the initial copper alloy may undergo one or more additional pre-processing steps, including, for example, casting, cropping, milling, hot rolling, slab milling, to obtain a desired shape. These pre-processing steps generally do not change the properties of the copper alloy.

In a first step 120, the initial copper alloy is cold worked a first time to a first percentage of cold working (% CW). Cold working is a metal forming process typically performed near room temperature, in which an alloy is passed through rolls, dies, or is otherwise cold worked to reduce the section of the alloy and to make the section dimensions uniform. This increases the strength of the alloy. The degree of cold working performed is indicated in terms of a percent reduction in thickness, or percent reduction in area, and is referred to in this disclosure as a percentage of cold working (% CW). In particular embodiments, the initial copper alloy is cold worked to a first % CW of from about 60% CW to about 95% CW, including from about 80% CW to about 95% CW, and from about 82% CW to about 92% CW.

In a second step 130, the cold-worked copper alloy is solution annealed for a first time. More specifically, the copper alloy that was cold-worked to a first % CW is solution annealed. Solution annealing involves heating a precipitation hardenable alloy to a high enough temperature to convert the microstructure into a single phase. A rapid quench to room temperature leaves the alloy in a supersaturated state that makes the alloy soft and ductile, helps regulate grain size, and prepares the alloy for aging. Subsequent heating of the supersaturated solid solution enables precipitation of the strengthening phase and hardens the alloy. After any solution annealing, a water quench should be performed to "lock in" the results. The quench rate should be a minimum of 30° F./second, and quench rates up to 100° F./second are acceptable.

The first solution annealing of step 130 may be performed at a temperature of about 950° C. (1742° F.) to about 1050° C. (1922° F.), or from about 980° C. (1796° F.) to about 1000° C. (1832° F.). The first solution annealing may be performed for a first time period of about 1 minute to about 10 minutes, and in more specific embodiments from about 2.5 minutes to about 5 minutes.

In step 140, the solution annealed copper alloy is cold worked a second time, to a second percentage of cold working (% CW). In particular embodiments, the second % CW is from about 30% CW to about 80% CW.

In step 150, the copper alloy is solution annealed a second time. The second solution annealing of step 150 may be performed at a temperature of about 950° C. (1742° F.) to about 1050° C. (1922° F.), or from about 980° C. (1796° F.) to about 1000° C. (1832° F.). The second solution annealing may be performed for a second time period of from about 1 minute to about 10 minutes, including from about 1.3 minutes to about 4 minutes.

In step 160, the copper alloy is cold worked a third time to a third percentage of cold working (% CW). In particular embodiments, the third % CW is from about 30% CW to about 80% CW, including from about 40% CW to about 80% CW. The minimum cumulative cold working from all three cold working steps is at least 85% CW.

It is noted that in some situations where the initial copper alloy casting is especially thick, a third solution annealing and a fourth cold working may be desired. In such cases, the third solution annealing may be performed according to the parameters described for step 150, and the fourth cold working may be performed according to the parameters described for step 160.

Then, in step 170, the cold-worked copper alloy is aged for a third time period to obtain the copper alloy with improved 0.2% offset yield strength. Aging is a heat treatment technique that produces ordering and fine particles (i.e. precipitates) of an impurity phase that impedes the movement of defects in a crystal lattice. This hardens the alloy. In particular embodiments, the alloy is aged at a temperature of about 400° C. (752° F.) to about 500° C. (932° F.), or from about 420° C. (788° F.) to about 450° C. (842° F.). The aging may be performed for a third time period of about four hours to about 20 hours, or from about four hours to about eight hours, or from about six hours to about 18 hours. It is noted that the aging can be performed at multiple different temperatures within these temperature ranges, with the total aging time being considered the third time period. Usually, when multiple different temperatures are used for aging, the successive aging temperature is lower than the previous aging temperature.

The copper alloy may be aged in a full hydrogen atmosphere. The term "full" means that the atmosphere in which the aging occurs is 100% hydrogen ($H_2$). For comparison, dry air contains roughly 0.5 to 1 ppmv hydrogen ($H_2$). Aging in a full hydrogen atmosphere is significant because the thermal conductivity of hydrogen is greater than that of air.

After steps 120-170, the copper alloy may be subjected to one or more post-processing steps 180. For example, the copper alloy may be pickled and/or brushed. At step 190, the process ends.

The copper alloys obtained after step 170 has improved 0.2% offset yield strength, and can be considered a "final" copper alloy. The final Cu—Cr—Si—Ag—Ti—Zr alloy may have one or more final properties such as, for example, a final 0.2% offset yield strength, a final ultimate tensile strength, a final formability ratio, a final % total elongation to break, and a final electrical conductivity (i.e. % IACS), as described above.

The 0.2% offset yield strength, ultimate tensile strength, and % total elongation to break are measured according to ASTM E8. The elastic modulus is measured according to ASTM E111-17. Formability may be measured by the formability ratio or R/t ratio (i.e. bend strength). This specifies the minimum inside radius of curvature (R) that is needed to form a 90° bend in a strip of thickness (t) without failure, i.e. the formability ratio is equal to R/t. Materials with good formability have a low formability ratio (i.e. low R/t), in other words a lower R/t is better. The formability ratio can be measured using the 90° V-block test, wherein a punch with a given radii of curvature is used to force a test strip into a 90° die, and then the outer radius of the bend is inspected for cracks. The formability ratio can also be reported as the ratio of the formability in the longitudinal (good way) direction to the formability in the transverse (bad way) direction, or as GW/BW.

In accordance with a third aspect of the present disclosure, articles formed from these Cu—Cr—Si—Ag—Ti—Zr copper alloys are described. The copper alloys of the present disclosure have a combination of good 0.2% offset yield strength, high formability, and high electrical conductivity.

The alloys can be formed into articles such as billet, plate, strip, foil, wire, rod, tube, or bar. For purposes of the present disclosure, billet is a solid metal form, usually having a large cross-sectional area. Plate is a flat surfaced product of generally rectangular cross-section with the two sides being straight and having a uniform thickness greater than 4.8 millimeters (mm), and with a maximum thickness of about 210 mm, and a width of greater than 30 mm. Strip is a flat surfaced product of generally rectangular cross-section with the two sides being straight and having a uniform thickness of up to 4.8 millimeters (mm). This is generally done by rolling an input to reduce its thickness to that of strip. Bar is as a flat surfaced product of generally rectangular cross-section and having a uniform thickness greater than 0.48 mm, and with a maximum width of 30 mm. Wire is a solid section other than strip, furnished in coils or on spools or reels. Rod is a round, solid section furnished in straight lengths. Tube is a seamless hollow product with round or other cross section. Foil is a very thin flat surfaced product, typically having a uniform thickness of 0.04 mm or less. It is noted there may be some overlap between these various articles.

The copper alloys of the present disclosure can also be used to make particular articles of varied shape for various applications, for example, a heat sink in a cellphone, or a wide range of electrical and electronic devices, components, and parts, such as wire, cabling, electrical connectors, electrical contacts, electrical ground plates, Faraday shield walls, heat spreaders, wire harness terminal contacts, processor socket contacts, backplane, midplane, or card-edge server connectors, and so forth.

The following examples are provided to illustrate the alloys, processes, articles, and properties of the present disclosure. The examples are merely illustrative and are not intended to limit the disclosure to the materials, conditions, or process parameters set forth therein.

EXAMPLES

Example 1

Figure 2:
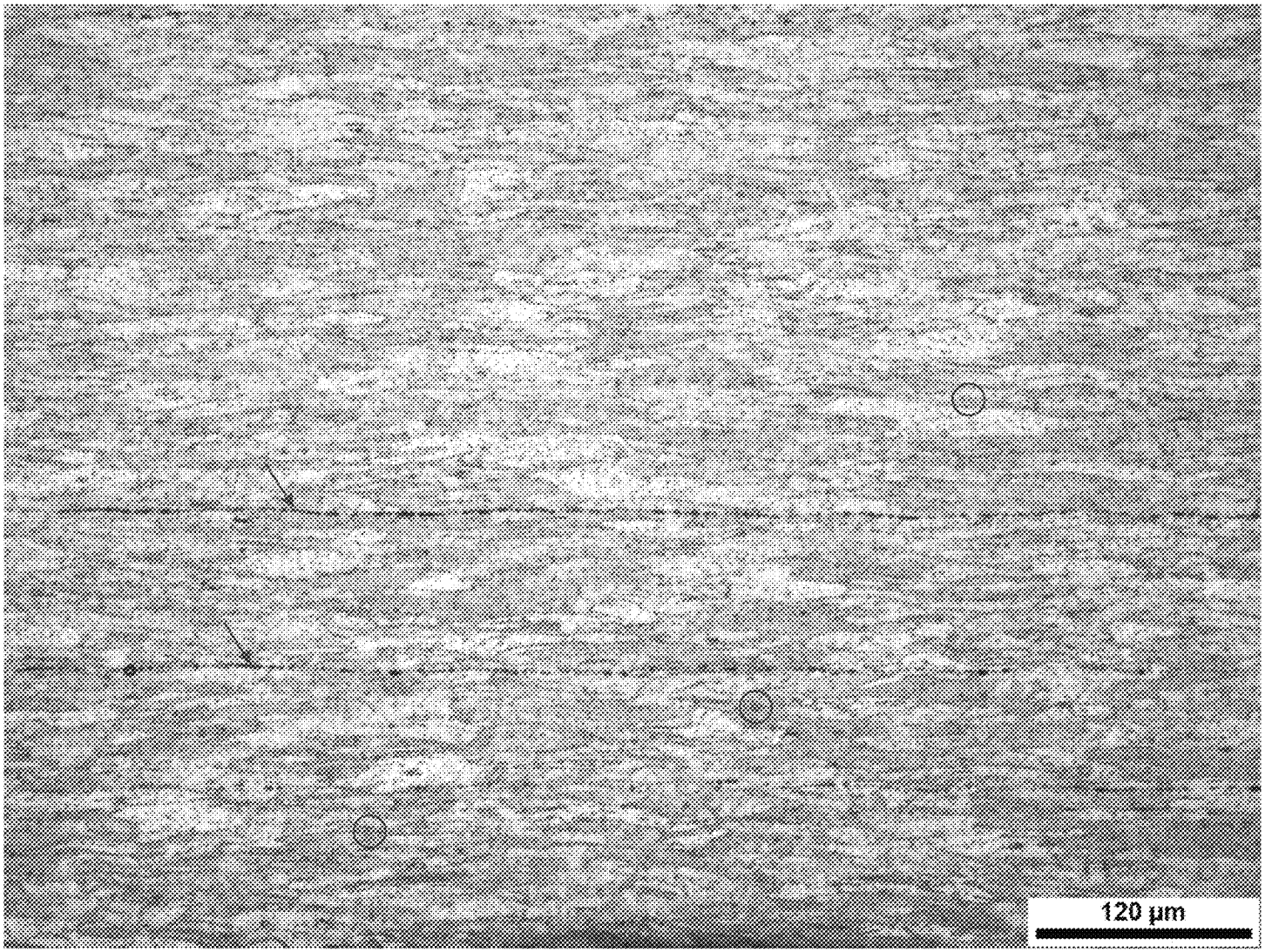
FIG. 2 is an image of an etched high-conductivity copper alloy in accordance with one aspect of this disclosure.

FIG. 2 is an image of an etched high-conductivity Cu—Cr—Si—Ag—Ti—Zr alloy in accordance with one aspect of this disclosure. The copper alloy exhibits improved precipitation strengthening. Indicated with arrows are lines of zirconium oxide or chromium oxide, which are benign. Circles indicate chromium silicides or chromium impurities. Zirconium silicides, which have the appearance of little needles and which are detrimental to the strength of the alloy, were not observed. Without being bound by theory, it is believed that zirconium silicides typically form at temperatures around 2400° F., and the copper alloy never reaches this temperature, so zirconium silicide is never formed. Alternatively, the zirconium is already bound up in the oxide or compounded with chromium, so there is no free zirconium to come out when zirconium silicide would normally precipitate.

Example 2

Several different alloys were made and processed according to the present disclosure. Their properties were then measured at several different points and averaged. Table A identifies the composition of the alloy for each heat, in wt % (balance copper). Table B describes the processing parameters applied to each heat. "CW" is the abbreviation for cold working. The two solution annealing temperatures were both 1810° F. Table C provides all measured results. Table D provides the average measured properties for each heat. The GW and BW refer to the formability measurements.

TABLE A

| Heat | Cr | Si | Ag | Ti | Zr | Other |
|---|---|---|---|---|---|---|
| 33354 | 0.66 | 0.040 | 0.11 | 0.015 | 0.015 | 0.01 Ni, 0.03 Fe |
| 33655 | 0.83 | 0.070 | 0.13 | 0.041 | 0.033 | <0.01 Ni, 0.01 Fe |
| 33656 | 0.72 | 0.080 | 0.13 | 0.02 | 0.026 | <0.01 Ni, <0.01 Fe |
| 33852 | 0.58 | 0.036 | 0.142 | 0.019 | 0028 | 0.01 Fe |
| 33851 | 0.77 | 0.062 | 0.139 | 0.042 | 0.022 | 0.01 Ni, 0.01 Fe |

TABLE B

| Heat | First CW % | First Gauge (in) | Second CW % | Second Gauge (in) | Third CW % | Final Gauge (in) | Aging Temp (° F.) |
|---|---|---|---|---|---|---|---|
| 33354 | 92 | 0.045 | 35 | 0.03 | 74 | 0.00787 | 825°/6 hr + 800°/6 hr |
| 33655 | 82 | 0.09 | 30 | 0.063 | 49 | 0.0315 | 825°/12 hr + 800°/6 hr |
| 33656-1 | 82 | 0.09 | 30 | 0.063 | 63.5 | 0.0236 | 800°/12 hr |
| 33656-2 | 82 | 0.09 | 39 | 0.0387 | 75 | 0.00986 | 800°/12 hr |
| 33852 | 82 | 0.09 | 35 | 0.0585 | 66.4 | 0.01968 | 825°/6 hr + 800°/6 hr |
| 33851-1 | 82 | 0.09 | 36 | 0.0576 | 72.5 | 0.01575 | 825°/6 hr + 800°/6 hr |
| 33851-2 | 82 | 0.09 | 40 | 0.054 | 74.5 | 0.01378 | 825°/6 hr + 800°/6 hr |

TABLE C

| Heat | Final Gauge (in) | UTS (ksi) | 0.2% YS (ksi) | % EL | Elastic Mod. (Msi) | % IACS |
|---|---|---|---|---|---|---|
| 33354 | 0.00787 | 83.2 | 78.9 | 9.26 | 21.6 | 81.4 |
| 33354 | 0.00787 | 83.2 | 78.9 | 9.13 | 21.6 | 79.9 |
| 33354 | 0.00787 | 83.1 | 79.3 | 9.23 | 21.6 | 80.8 |
| 33354 | 0.00787 | 83.1 | 79.3 | 8.96 | 22 | 81.2 |
| 33354 | 0.00787 | 83.2 | 79.1 | 8.85 | 21.5 | 81.1 |
| 33354 | 0.00787 | 83.3 | 79 | 8.75 | 21.7 | 81.5 |
| 33354 | 0.00787 | 80.7 | 76.1 | 9.67 | 22.3 | 84.2 |
| 33354 | 0.00787 | 81.1 | 76.5 | 9.31 | 21.8 | 82.8 |
| 33354 | 0.00787 | 80.2 | 75.4 | 10.21 | 22.1 | 83.2 |
| 33354 | 0.00787 | 80.1 | 75.6 | 9.75 | 22.4 | 83.4 |
| 33354 | 0.00787 | 82 | 77.2 | 9.67 | 21.9 | 82.8 |
| 33354 | 0.00787 | 81.6 | 77 | 10.1 | 21.9 | 84.2 |
| 33655 | 0.0315 | 79.4 | 74.3 | 10.12 | 21.1 | 81.0 |
| 33655 | 0.0315 | 78.8 | 73.8 | 10.56 | 21.2 | 81.0 |
| 33655 | 0.0315 | 79.7 | 74.6 | 10.36 | 21.5 | 81.3 |
| 33655 | 0.0315 | 80.0 | 74.8 | 10.18 | 21.6 | 81.4 |
| 33655 | 0.0315 | 80.0 | 74.8 | 10.43 | 21.6 | 81.3 |
| 33655 | 0.0315 | 80.0 | 74.8 | 10.21 | 21.8 | 81.1 |
| 33655 | 0.0315 | 79.7 | 74.7 | 10.34 | 22.6 | 81.2 |
| 33655 | 0.0315 | 79.3 | 74.3 | 10.41 | 21.5 | 81.5 |
| 33655 | 0.0315 | 79.2 | 74.2 | 10.18 | 21.9 | 81.2 |
| 33655 | 0.0315 | 78.8 | 73.8 | 10.10 | 21.7 | 81.4 |
| 33655 | 0.0315 | 79.8 | 74.5 | 10.02 | 22 | 79.5 |
| 33655 | 0.0315 | 80 | 74.7 | 10.25 | 22.1 | 79.9 |
| 33655 | 0.0315 | 80.1 | 74.7 | 10.06 | 22.3 | 79.6 |
| 33655 | 0.0315 | 80.2 | 74.8 | 10.2 | 21.9 | 80.0 |
| 33655 | 0.0315 | 80.5 | 74.9 | 9.98 | 20.8 | 79.8 |
| 33655 | 0.0315 | 80.2 | 74.8 | 10.23 | 20.5 | 79.4 |
| 33655 | 0.0315 | 80.5 | 74.6 | 9.97 | 22.6 | 79.9 |
| 33655 | 0.0315 | 80.5 | 74.9 | 9.86 | 22.1 | 79.8 |
| 33655 | 0.0315 | 79.7 | 74.1 | 9.75 | 21.5 | 79.9 |
| 33656-1 | 0.0236 | 81.4 | 76.7 | 9.59 | 24.1 | 80.0 |
| 33656-1 | 0.0236 | 81.8 | 76.8 | 9.13 | 23.8 | 80.2 |
| 33656-1 | 0.0236 | 81.8 | 77 | 9.01 | 23.9 | 80.1 |
| 33656-1 | 0.0236 | 81.8 | 77.1 | 9.53 | 24.1 | 80.4 |
| 33656-1 | 0.0236 | 81.7 | 76.8 | 8.24 | 19.6 | 80.3 |
| 33656-1 | 0.0236 | 81.7 | 76.8 | 9.54 | 19.63 | 80.2 |
| 33656-1 | 0.0236 | 81.8 | 77 | 9.49 | 22.6 | 80.1 |
| 33656-1 | 0.0236 | 81.6 | 76.5 | 9.22 | 19.53 | 80.1 |
| 33656-1 | 0.0236 | 81.8 | 77 | 9.09 | 20.2 | 80.1 |
| 33656-1 | 0.0236 | 81.6 | 76.8 | 8.9 | 23.9 | 80.3 |
| 33656-1 | 0.0236 | 81.6 | 76.5 | 9.04 | 21.2 | 79.0 |
| 33656-1 | 0.0236 | 81.8 | 77.1 | 9.6 | 21.0 | 79.2 |
| 33656-1 | 0.0236 | 81.8 | 76.7 | 9.77 | 22.6 | 79.1 |
| 33656-1 | 0.0236 | 81.7 | 76.7 | 9.6 | 22.3 | 79.5 |
| 33656-1 | 0.0236 | 81.2 | 76.1 | 9.86 | 21.4 | 79.0 |
| 33656-1 | 0.0236 | 81.3 | 76.1 | 9.56 | 21.4 | 79.6 |
| 33656-1 | 0.0236 | 81.3 | 76.3 | 10.06 | 22.0 | 79.2 |
| 33656-1 | 0.0236 | 81.4 | 76.4 | 9.95 | 21.9 | 79.3 |
| 33656-1 | 0.0236 | 81.5 | 76.5 | 9.43 | 21.6 | 79.1 |
| 33656-1 | 0.0236 | 81.4 | 76.6 | 9.28 | 21.4 | 79.3 |
| 33656-2 | 0.00984 | 81.1 | 76.5 | 8.42 | 21.7 | 82.8 |
| 33656-2 | 0.00984 | 81.1 | 76.8 | 8.55 | 21.8 | 82.5 |
| 33656-2 | 0.00984 | 80.2 | 76.1 | 8.92 | 21.5 | 83.0 |
| 33656-2 | 0.00984 | 80.2 | 76.4 | 8.51 | 21.2 | 83.0 |
| 33656-2 | 0.00984 | 80.8 | 77.0 | 9.1 | 21.5 | 83.4 |
| 33656-2 | 0.00984 | 80.8 | 76.9 | 9.0 | 20.8 | 82.8 |
| 33656-2 | 0.00984 | 80.1 | 75.9 | 8.62 | 21.7 | 83.6 |
| 33656-2 | 0.00984 | 80.1 | 76.2 | 8.45 | 21.9 | 83.8 |
| 33656-2 | 0.00984 | 81.5 | 77.2 | 8.81 | 21.8 | 83.0 |
| 33656-2 | 0.00984 | 81.7 | 77.9 | 8.37 | 22.5 | 83.8 |
| 33656-2 | 0.00984 | 81.8 | 78.4 | 7.41 | 21.8 | 81.3 |
| 33656-2 | 0.00984 | 82.1 | 78.4 | 8.22 | 21.0 | 82.6 |
| 33656-2 | 0.00984 | 82.4 | 79.0 | 7.75 | 22.5 | 81.9 |
| 33656-2 | 0.00984 | 82.2 | 78.8 | 7.24 | 22.5 | 83.2 |
| 33656-2 | 0.00984 | 82.1 | 78.5 | 7.75 | 22.3 | 82.8 |
| 33656-2 | 0.00984 | 82.0 | 78.4 | 7.56 | 21.2 | 83.0 |
| 33656-2 | 0.00984 | 82.2 | 78.4 | 7.69 | 21.2 | 82.2 |
| 33656-2 | 0.00984 | 82.2 | 78.4 | 7.72 | 21.3 | 82.3 |
| 33656-2 | 0.00984 | 82.4 | 79 | 7.5 | 21.6 | 83.1 |
| 33656-2 | 0.00984 | 82.5 | 79.1 | 7.58 | 22.0 | 82.9 |
| 33852 | 0.01968 | 81.1 | 76.1 | 8.64 | 21.1 | 79.3 |
| 33852 | 0.01968 | 80.6 | 75.7 | 8.68 | 23.7 | 79.4 |
| 33852 | 0.01968 | 80.5 | 75.7 | 8.41 | 23.7 | 79.1 |
| 33852 | 0.01968 | 80.6 | 75.9 | 9.53 | 20.2 | 79.1 |
| 33852 | 0.01968 | 80.7 | 75.8 | 8.49 | 20.7 | 79.3 |

TABLE C-continued

| Heat | Final Gauge (in) | UTS (ksi) | 0.2% YS (ksi) | % EL | Elastic Mod. (Msi) | % IACS |
|---|---|---|---|---|---|---|
| 33852 | 0.01968 | 80.8 | 75.9 | 9.39 | 23.8 | 79.2 |
| 33852 | 0.01968 | 80.7 | 75.7 | 9.59 | 23.9 | 79.6 |
| 33852 | 0.01968 | 81 | 75.9 | 8.49 | 20.5 | 79.0 |
| 33852 | 0.01968 | 80.6 | 75.7 | 8.96 | 21.1 | 79.4 |
| 33852 | 0.01968 | 81.1 | 76.2 | 8.94 | 24.3 | 80.0 |
| 33852 | 0.01968 | 80.1 | 75.4 | 8.75 | 20.1 | 79.2 |
| 33852 | 0.01968 | 80.3 | 75.6 | 9.09 | 20.5 | 79.4 |
| 33851-1 | 0.01575 | 83.5 | 78.9 | 8.88 | 21.6 | 81 |
| 33851-1 | 0.01575 | 83 | 78 | 9.01 | 23 | 81.2 |
| 33851-1 | 0.01575 | 83.3 | 78.7 | 8.92 | 22.5 | 81 |
| 33851-1 | 0.01575 | 83.6 | 79.4 | 8.83 | 21.5 | 81.3 |
| 33851-1 | 0.01575 | 83.1 | 78.7 | 8.71 | 21.5 | 81 |
| 33851-1 | 0.01575 | 82.7 | 77.8 | 8.98 | 22.4 | 81.2 |
| 33851-1 | 0.01575 | 84.8 | 80.1 | 8.77 | 23 | 78.7 |
| 33851-1 | 0.01575 | 84.7 | 80.3 | 8.86 | 21.1 | 79.3 |
| 33851-1 | 0.01575 | 84.8 | 80.3 | 9.05 | 21.1 | 79.8 |
| 33851-1 | 0.01575 | 84.6 | 80.3 | 8.81 | 21.8 | 79.2 |
| 33851-1 | 0.01575 | 84.7 | 80.1 | 8.85 | 21.5 | 79.3 |
| 33851-1 | 0.01575 | 84.9 | 80.4 | 8.97 | 21.5 | 79.3 |
| 33851-2 | 0.01378 | 84.9 | 81 | 8.85 | 20.6 | 79.5 |
| 33851-2 | 0.01378 | 85.4 | 81.2 | 8.58 | 21.1 | 79.8 |
| 33851-2 | 0.01378 | 85.9 | 81.5 | 8.85 | 23.3 | 78.6 |
| 33851-2 | 0.01378 | 84.9 | 81.1 | 9.07 | 24.2 | 79.5 |
| 33851-2 | 0.01378 | 85.4 | 81.1 | 8.44 | 21 | 79.1 |
| 33851-2 | 0.01378 | 85.3 | 81.2 | 8.58 | 21.2 | 79.4 |
| 33851-2 | 0.01378 | 85.7 | 81.1 | 8.9 | 23.2 | 78.3 |
| 33851-2 | 0.01378 | 85.8 | 81.4 | 8.79 | 23.4 | 78.2 |
| 33851-2 | 0.01378 | 85.9 | 81.8 | 8.44 | 21 | 78.7 |
| 33851-2 | 0.01378 | 85.7 | 81.3 | 9.36 | 23.5 | 78.6 |
| 33851-2 | 0.01378 | 85.6 | 81.3 | 8.25 | 22.5 | 78.8 |
| 33851-2 | 0.01378 | 85.9 | 82 | 8.03 | 21 | 79.1 |

TABLE D

| Heat | Final Gauge (in) | UTS (ksi) | 0.2% YS (ksi) | % EL | Elastic Mod. (Msi) | % IACS | GW | BW |
|---|---|---|---|---|---|---|---|---|
| 33354 | 0.00787 | 82.1 | 77.7 | 9.4 | 21.9 | 82.2 | 0.0 | 0.0 |
| 33655 | 0.0315 | 79.8 | 74.5 | 10.2 | 21.7 | 80.5 | 0.0 | 0.0 |
| 33656-1 | 0.0236 | 81.6 | 76.7 | 9.4 | 21.9 | 79.7 | 0.0 | 0.0 |
| 33656-2 | 0.00986 | 81.5 | 77.7 | 8.2 | 21.7 | 82.9 | 0.0 | 0.0 |
| 33852 | 0.01968 | 80.7 | 75.8 | 8.9 | 22.0 | 79.3 | 0.0 | 0.0 |
| 33851-1 | 0.01575 | 84.0 | 79.4 | 8.9 | 21.9 | 80.2 | 0.0 | 0.0 |
| 33851-2 | 0.01378 | 85.5 | 81.3 | 8.7 | 22.2 | 79.0 | 0.0 | 0.0 |

To summarize the results in Table D, the average 0.2% offset yield strength ranged from 75 ksi to 80 ksi. The average ultimate tensile strength (UTS) ranged from 80 ksi to 85 ksi. The average electrical conductivity (% IACS) ranged from 78% IACS to 81% IACS. The formability of all heats was high.

Example 3

Several additional alloys were made and processed according to the present disclosure. Their properties were then measured at several different points and averaged. Table E identifies the composition of the alloy for each heat, in wt % (balance copper). All heats were solution annealed at a temperature of about 950° C. (1742° F.) to about 1050° C. (1922° F.), and aged at 825° F. for 6 hours and then at 800° F. for another 6 hours. Table F provides the average measured properties for each heat. The GW and BW refer to the formability measurements.

TABLE E

| Heat | Cr | Si | Ag | Ti | Zr | Other |
|---|---|---|---|---|---|---|
| 34208 | 0.756 | 0.045 | 0.137 | 0.022 | 0.010 | Co, 0.01, Fe 0.01, Ni 0.02 |
| 34446 | 0.654 | 0.05 | 0.0131 | 0.032 | 0.023 | Co, 0.01, Fe 0.01, Ni 0.02 |
| 33852 | 0.580 | 0.04 | 0.142 | 0.019 | 0.028 | Fe 0.01 |
| 34447 | 0.082 | 0.04 | 0.137 | 0.025 | 0.030 | Co, 0.01, Fe 0.02, Ni 0.01 |
| 33851 | 0.77 | 0.06 | 0.139 | 0.042 | 0.022 | Fe 0.01, Ni 0.01 |
| 34493 | 0.667 | 0.04 | 0.138 | 0.02 | 0.01 | Fe 0.01, Ni 0.01 |
| 34535 | 0.708 | 0.04 | 0.110 | 0.021 | 0.034 | Co, 0.01, Fe 0.01, Ni 0.01 |
| 34536 | 0.623 | 0.04 | 0.0104 | 0.026 | 0.024 | Co, 0.01, Fe 0.01, Ni 0.01 |

TABLE F

| Heat | Final Gauge (in) | UTS (ksi) | 0.2% YS (ksi) | % EL | Elastic Mod. (Msi) | % IACS | GW | BW |
|---|---|---|---|---|---|---|---|---|
| 34208 | 0.0118 | 80.4 | 75.9 | 9.00 | 21.78 | 84.9 | 0.1 | 0.1 |
| 34446 | 0.315 | 77.8 | 71.6 | 10.5 | — | 80.1 | 0.1 | 0.1 |
| 33852 | 0.01969 | 80.2 | 75.3 | 9.0 | — | 81.8 | 0.1 | 0.1 |
| 34447 | 0.01969 | 80.1 | 75.4 | 8.5 | — | 81.1 | 0.2 | 0.2 |
| 33851 | 0.01575 | 82.9 | 79.0 | 8.4 | — | 79.6 | 0.2 | 0.2 |
| 34493 | 0.01969 | 79.1 | 74.1 | 9.2 | — | 79.3 | 0.2 | 0.2 |
| 34535 | 0.01969 | 81.2 | 76.6 | 9.7 | — | 80.7 | 0.2 | 0.2 |
| 34536 | 0.01969 | 82.1 | 77.4 | 9.2 | — | 79.3 | 0.2 | 0.2 |

Comparative Example 1

A Cu-0.59Cr-0.16Ni-0.09Ag-0.04Si alloy was processed according to the present disclosure (i.e. three cold working steps, two solution annealing steps, and aging). The resulting alloy had a 0.2% offset yield strength of 67.4 ksi and a conductivity of 78.5% IACS.

Comparative Example 2

A Cu-0.94Cr-0.41Ni-0.15Si alloy was processed through three cold working steps and two solution annealing steps as described in the present disclosure, and aged at 825° F. for three hours. The resulting alloy had a 0.2% offset yield strength of 73 ksi and a conductivity of 68% IACS.

Different heat treatments were performed on this alloy. The measured 0.2% offset yield strengths ranged from 65-70 ksi, and the conductivities ranges from 62-67% IACS.

For comparison, a Cu—Cr—Si—Ag—Ti—Zr alloy of the present disclosure was processed with the same parameters. This alloy had a 0.2% offset yield strength of 74 ksi and a conductivity of 74% IACS, i.e. higher values for both properties.

Comparative Example 3

Some Ni—Cr—Si—Mn—Zr alloys were made and processed similarly to the present disclosure. Instead of three cold working steps and two solution annealing steps before aging as in the present disclosure, these alloys were processed with two cold working steps and one solution annealing step before aging.

Their properties were then measured and averaged. Table E identifies the composition of the alloy for each heat, in wt % (balance copper). Table F describes the processing parameters applied to each heat. "CW" is the abbreviation for cold working. The two solution annealing temperatures were both 1810° F. Table G provides the average measured properties for each run.

TABLE E

| Heat | Ni | Cr | Si | Mn | Zr | Other |
|---|---|---|---|---|---|---|
| 33658 | 1.33 | 0.33 | 0.38 | 0.135 | 0.049 | 0.01 Fe |
| 33661 | 1.4 | 0.36 | 0.43 | 0.134 | 0.045 | 0.01 Fe |
| 33356 | 1.22 | 0.26 | 0.38 | 0.074 | <0.004 | 0.015 Fe |
| 33855 | 1.36 | 0.37 | 0.42 | 0.134 | 0.042 | 0.01 Fe |

TABLE F

| Heat | First CW % | First Gauge (in) | Second CW % | Final Gauge (in) | Aging Temp (° F.) |
|---|---|---|---|---|---|
| 33658 | 82 | 0.09 | 64 | 0.0315 | 825°/6 hr + 800°/6 hr |
| 33661-1 | 82 | 0.09 | 74 | 0.0236 | 825°/6 hr + 800°/6 hr |
| 33661-2 | 82 | 0.09 | 89 | 0.0098 | 825°/6 hr + 800°/6 hr |
| 33356 | 91 | 0.051 | 84 | 0.00787 | 825°/6 hr + 800°/6 hr |
| 33855 | 91 | 0.045 | 82 | 0.00787 | 825°/6 hr + 800°/6 hr |

TABLE G

| Heat | Final Gauge (in) | UTS (ksi) | 0.2% YS (ksi) | % EL | Elastic Mod. (Msi) | % IACS | GW | BW |
|---|---|---|---|---|---|---|---|---|
| 33658 | 0.0315 | 96.55 | 89.52 | 9.69 | 21.41 | 49.49 | 0.10 | 0.30 |
| 33661-1 | 0.0236 | 97.21 | 89.46 | 9.74 | 20.54 | 49.03 | 0.10 | 0.50 |
| 33661-2 | 0.0098 | 90.16 | 79.76 | 11.14 | 20.99 | 52.84 | 0.00 | 0.10 |
| 33356 | 0.00787 | 93.7 | 84.4 | 10 | | 50 | 0.5 | 0.5 |
| 33855 | 0.00787 | 91.14 | 84.99 | 8.15 | 21.84 | 50.28 | 0.0 | 0.0 |

As can be seen here, the % IACS for these alloys is relatively low, and does not exceed 53% IACS.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A copper alloy, comprising:

from about 0.55 wt % to about 0.85 wt % chromium;

from about 0.02 wt % to about 0.1 wt % silicon;

from about 0.1 wt % to about 0.2 wt % silver;

from about 0.015 wt % to about 0.05 wt % titanium;

from about 0.02 wt % to about 0.06 wt % zirconium, wherein the zirconium is present as zirconium oxide; and balance copper;

wherein the copper alloy has a 0.2% offset yield strength of at least 70 ksi and an electrical conductivity of at least 75% IACS and wherein the copper alloy is devoid of zirconium silicides.

2. The copper alloy of claim 1, further having an ultimate tensile strength of at least 80 ksi.

3. The copper alloy of claim 1, further having a % total elongation to break of at least 7%.

4. The copper alloy of claim 1, further having a formability ratio in the longitudinal direction to the transverse direction of 0.0/0.0.

5. The copper alloy of claim 1, wherein the copper alloy has a 0.2% offset yield strength of at least 75 ksi and an electrical conductivity of at least 80% IACS.

6. The copper alloy of claim 1, wherein the copper alloy has an ultimate tensile strength of at least 75 ksi; and a % total elongation to break of at least 7%.

7. The copper alloy of claim 1, wherein the copper alloy does not contain tin or beryllium.

8. An article formed from the copper alloy of claim 1.

9. The article of claim 8, wherein the article is a billet, plate, strip, foil, wire, rod, tube, or bar.

* * * * *